United States Patent [19]

Nakamura et al.

[11] 4,396,442

[45] Aug. 2, 1983

[54] DUCTILE CAST IRON ROLL AND A MANUFACTURING METHOD THEREOF

[75] Inventors: Shiro Nakamura, Ashiya; Masahiro Fukuda; Akitoshi Okabayashi, both of Itami, all of Japan

[73] Assignee: Kubota Ltd., Osaka, Japan

[21] Appl. No.: 263,903

[22] Filed: May 15, 1981

[51] Int. Cl.[3] ..... C22C 37/06; C22C 37/08; C22C 37/10; C21D 9/38

[52] U.S. Cl. ..... 148/138; 75/124; 75/128 D; 75/128 W; 148/35

[58] Field of Search ..... 148/35, 138; 75/128 D, 75/128 W, 124 B, 124 E

[56] References Cited

U.S. PATENT DOCUMENTS

| | | | |
|---|---|---|---|
| 1,391,215 | 9/1921 | Speer | 75/128 D |
| 2,804,414 | 8/1957 | Moss et al. | 75/128 D |
| 3,273,998 | 9/1966 | Knoth et al. | 75/128 D |
| 4,124,413 | 11/1978 | Komatsu et al. | 75/128 D |

OTHER PUBLICATIONS

Separate–Volume of Supplement of "METAL", Jun. 15, 1963, pp. 6–8, Activity of Tough Cast Iron by Tetsuo Takenaka.

*Primary Examiner*—W. Stallard

*Attorney, Agent, or Firm*—Oblon, Fisher, Spivak, McClelland & Maier

[57] ABSTRACT

The present invention relates to a ductile cast iron roll which is excellent in its resistance breaking and which has the chemical composition comprising 3.0–3.8% C, 1.5–2.5% Si, 0.2–1.0% Mn, 0.01–0.2% P, less than 0.06% S, 0.7–3.0% Ni, 0.1–0.6% Cr, 0.1–0.8% Mo, 0.02–0.1% Mg, balance iron and unavoidable impurities and the base structure having a fine two-phase structure of ferrite mingled with pearlite.

The cast iron roll is manufactured by holding the said cast iron roll at the temperature 780°~850° C. for less than 20 hours; and after that by cooling the same down to 760° C. at the cooling speed 50~300° C./Hr; and after that by holding the same at the temperature 450°~650° C. for less than 20 hours.

9 Claims, 14 Drawing Figures

DUCTILE CAST IRON ROLL AND A MANUFACTURING METHOD THEREOF

BACKGROUND OF THE INVENTION

Present invention relates to a ductile cast iron roll which has excellent resistance to cracking and a method manufacturing said roll.

In the rough rolling stand of the hot rolling machine, the thermal load on the roll is extremely heavy due to the high temperature of the material to be rolled and due to slow rolling speed. For this reason, the roll for the rough rolling is apt to crack due to the thermal fatigue, and as a result, there are many break downs caused by the development of these cracks in the roll.

Hitherto, ductile cast iron rolls were used in the rough rolling stand of the hot rolling machine; these prior art rolls have globular graphites dispersed there; the said dispersed globular graphites block the development of the cracks and thereby the cracks are dispersed like the pattern on a tortoise shell; therefore, ductile cast iron roll is believed to have been provided with a comparatively good resistance to cracking.

However, conventional ductile cast iron roll was still insufficient in the cracking resistance for severe conditions of heat and load when the roll is in the rough rolling stand of the hot rolling operation as mentioned above, and the occurrence of the breaking accident of the roll was not small in number. It is needless to say that the occurrence of the breaking accident of the roll will cause not only the increase in the consumption volume of the roll but also the decline in the rolling work efficiencies and resultant lowering of the productivity.

In order to give an excellent resistance to breaking to the roll, it is necessary to enhance the resistance to the occurrence and development of the cracks, namely the resistance to cracking must be enhanced. In order to enhance this cracking resistivity, it is necessary to improve the toughness, namely the elongation value at the tension test and the flexibility volume at the breaking test must be improved. For this purpose there are two ways, one is to decrease the volume of cementite in the structure and another is to enhance the toughness of the base. As to the former method, though it was put in practice up to this time, the decreased volume of cementite in the structure is apt to cause a decline in the abrasive resistivity as a result. Because the roll for the rolling machine which is the object of the present invention requires considerable abrasion resistivity, there is naturally a limit to the improvement of the toughness by this method.

Therefore, the present invention focused on the latter method, and after making various studies, it became possible to specify the chemical compounds and compositions, and structures as mentioned above, thereby the resistance to the occurrence of heat cracking is enhanced and, the resistance to breaking made superior.

SUMMARY OF THE DISCLOSURE

The present invention, in view of the problems mentioned above, is to offer a ductile cast iron roll for the rolling machine, which is adequately provided with a resistance to breaking sufficient to satisfy the severe conditions of operation as mentioned above.

The objective of the present invention is to offer a ductile cast iron roll which is excellent in its resistance to breaking and which has a chemical composition consisting of C about 3.0~3.8% (Weight %; the same applies correspondingly to the following), Si about 1.5~2.5%, Mn about 0.2~1.0%, P about 0.01~0.2%, S not exceeding about 0.06%, Ni about 0.7~3.0%, Cr about 0.1~0.6%, Mo about 0.1~0.8%, Mg about 0.02~0.1%, balance iron, and unavoidable impurities, and which has in addition fine two-phase structure of ferrite mingled with pearlite as the base structure.

Furthermore, the present invention offers the manufacturing method of the ductile cast iron roll which is excellent in its resistance to breaking.

Figure 7I:
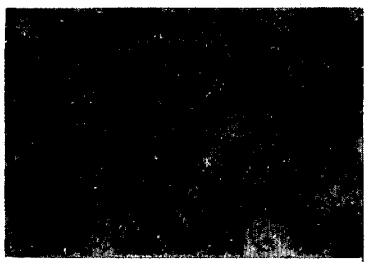
Figure 7:
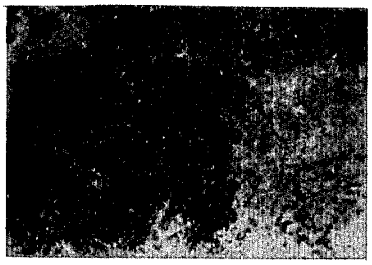
Figure 10I:
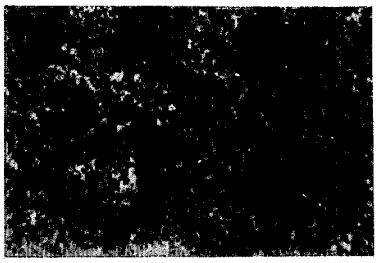
Figure 10:
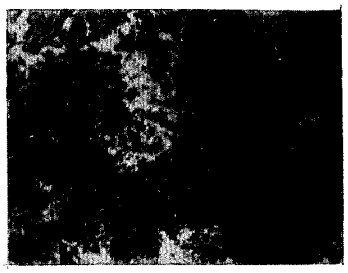

From FIGS. 7 (I) and (II) to FIGS. 10 (I) and (II) are the photographs, which serve as the drawings, showing other examples of the structures of the ductile cast iron rolls in accordance with this invention. (In all photographs, (I)'s are 100 magnifications and (II)'s are 400 magnifications.

DETAILED DESCRIPTION OF THE PREFERRED EMBODIMENTS

In the next place, the reason for the limitation of the constituents of the materials for the ductile cast iron roll will be described.

C is directly participated in the formation of cementite and graphite in the material. If the volume of C is less than about 3.0%, the volumes of cementite and graphite will become insufficient and the dispersion effect of the heat cracks will resultantly become inadequate. As a result, the ductile cast iron will not have the desired characteristic. However, if the volume of C is too large, it will cause the material to become brittle. Therefore, the upper limit of the volume of C shall be about 3.8%.

Figure 1:
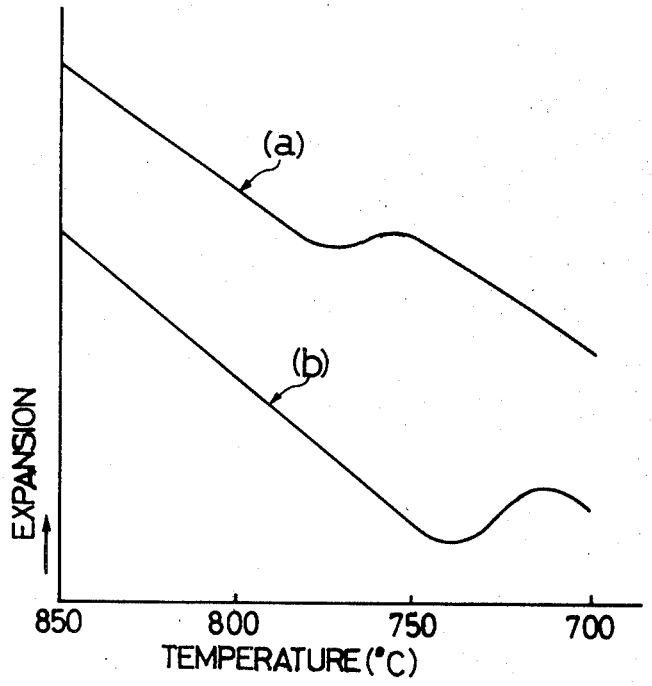
FIG. 1 is a graph showing the transformationl conditions of the ductile cast iron which is indicated by the expansion volumes in connection with temperature.

Si effects the formation of cementite. If the volume of Si is less than about 1.5%, the volume of cementite will become excessive, thereby it will cause the frangibility of the product and in addition, the coexistence area of ferrite and austenite will disappear. In the roll which is manufactured in accordance with this invention, the two-phase structure of ferrite and pearlite can be obtained by utilizing the coexistence area of ferrite and austenite at the eutectoid transformation temperature in the heat treatment as will described afterward. If the coexistence area of ferrite and austenite disappears by the insufficiency of Si, the structure of the base described above can not be obtained. In FIG. 1 the transformation conditions, at the time of heating, of two kinds of cast irons (a) and (b) which differ in their constituents and compositions are illustrated by the expansion volumes (heating speed: 194° C./Hr.). In this connection, (a) is a cast iron containing C 3.38%, Si 2.08%, Mn 0.49%, Ni 1.76%, Cr 0.18%, and Mo 0.16% (Prescribed scope of this invention). (b) is also a cast iron containing 3.41%, Si 1.08%, Mn 0.72%, Ni 2.41%, Cr 0.62% and Mo 0.48% (Si is insufficient in volume and Cr is excessive in volume). In case of cast iron (a), the shrinkage volume at the eutectoid transformation is small because ferrite and austenite are in the coexistent condition due to the deposition of ferrite. On the contrary, in case of cast iron (b) where the amount of Si is small, the shrinkage volume of the eutectoid transformation is large because it indicates that the cast iron becomes one-phase structure of austenite due to predominant austenitization. Accordingly, in order to retain ferrite and austenite in the coexistent condition by avoiding the perfect austenitization, the amount of Si must be made more than about 1.5%. On the other hand, if the volume of Si exceeds about 2.5%, the volume of graphite will become too much, graphite itself will be softened, and by these phenomena, the structure of the base will become fragile and the transition temperature will go up. Therefore, the volume of Si exceeding about 2.5% is considered to be undesirable.

Mn is effective in offsetting the damaging effects of S which is apt to mingle as impurities. On that reason, Mn of more than about 0.2% is to be added. Though Mn has an effect to improve the hardness of the base however if the content of Mn is increased too much, the quality of the material will become fragile. Accordingly, the upper limit is set at about 1.0%.

P will make the quality of the material fragile, therefore the content must be made less than 0.2%. Moreover, P will improve the fluidity of the molten metal and the abrasion resistivity. Therefore, P is present in an amount of at least 0.01%, and no more than about 0.2%.

S will make the quality of the material fragile as in case of P, and moreover it will obstract the formation of the globular shape of graphite. Therefore the content must be made less than about 0.06%.

Ni has an effect to improve the graphitization and the hardness of the base, but if the content is less, the volume of graphite will become insufficient and the hardness of the base will also become low. On this reason, the content must be made more than about 0.7%. However, if the content exceeds about 3.0%, the volume of cementite will be decreased, at the same time, the base will be apt to become bainite and martensite which are thermally unstable. Therefore it is considered to be unsuitable as a roll material for the hot rolling machine.

Cr is a stabilizer element for cementite, however if the content falls short of about 0.1%, cementite will decrease to almost nothing which will reduce the abrasion resistance to an unsatisfactory level. On the other hand, if the content of Cr exceeds about 0.6%, the amount of cementite will become excessive and thereby the quality of the material will become fragile. Moreover, these troubles will make it difficult to obtain the structure of the base which consists of two phases of ferrite and pearlite and which is the objective of the present invention.

Mo has a function to stabilize cementite and to enhance the hardness of the base. However, in case of the content of Mo is less than about 0.1%, the volume of stabilized cementite obtained will become excessive and the improvement effect of the hardness of the base will gradually be saturated, thus the content of Mo exceeding about 0.8% is considered to be uneconomical.

Mg is needed in forming globular-shape for graphite. In case of the content less than about 0.02%, the effect will become insufficient. On the other hand, if the content exceeds about 0.1%, the defects are apt to occur in the casting process. Besides this, it will cause the fragility of the quality of the material due to the increase of cementite.

The roll material in accordance with the present invention may contain Al and rare earth element besides various elements mentioned above.

Al has its graphitization function, therefore it may be contained in the material in accordance with the operating condition of the roll. Especially, it is effective in case of the roll materials which are to be used on the rolling stand in which the conditions for heat and load are severe. However, Al is to obstruct the globularization of graphite, so the upper limit is set at about 0.3%.

Rare earth elements such as La, Ce, etc. are effective as stabilizers for the globularization of graphite. However, if the total volume of rare earth elements exceed about 0.05%, the effect will almost be saturated, so the upper limit is set at about 0.05%.

Figure 5:
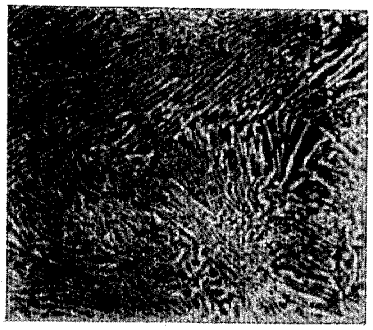
FIG. 5 is a photograph (2,000 magnifications), which serves as a drawing, showing the casting structure of the ductile cast iron of the roll.
Figure 6:
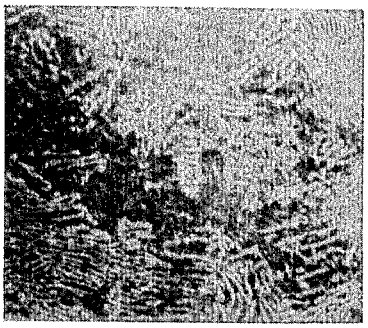
FIG. 6 is a photograph (2,000 magnifications), which serves as a drawing, showing the structure of the ductile cast iron roll in accordance with this invention.

In the present invention, the roll which is consisting of the above-mentioned constituents and compositions is, up to the casting stage, the one-phase structure of pearlite (Refer to FIG. 5), but then the roll will have the fine two-phase structure of mingled ferrite and pearlite, as shown in FIG. 6, by the heat treatment. The pearlite portion will give the resistance to abrasion which is required by the roll as an essential part of the rolling machine, while the ferrite portion will contribute to the remarkable improvement of the breaking resistivity by preventing the development of the cracks and by enhancing the toughness of the roll. In order to obtain the two-phase structure of ferrite and pearlite, the structure must once be made into a coexistent structure of ferrite and austenite and then the said austenite must be transformed into pearlite from the former state.

According to the present invention, the roll with the above-mentioned constituents and compositions will be held for about 20 hours at the temperature about 780°~850° C. and in the second place, the said roll will be subjected to the heat treatment in which it will be cooled down to about 60° C. at the cooling speed about 50°~300° C./Hr.

Figure 2:
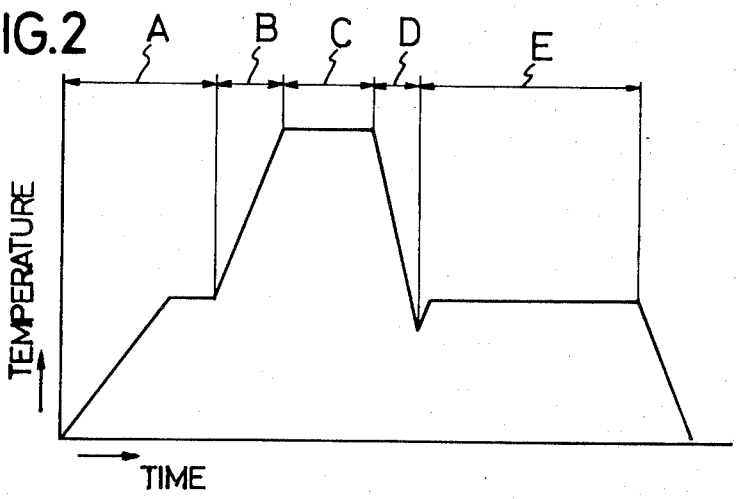
FIG. 2 is a graph showing the embodiment of the heat pattern of the heat treatment method of the present invention.

In the following, the heat treatment of this invention is described based on the heat pattern shown in FIG. 2.

In the figure, A and B portions are the rising heat process. Its heating speed may be properly adjusted in accordance with the capacity of the heat treatment furnace in order to avoid the occurrences of the troubles such as the breakages due to the heat strains. There is no special restriction other than those mentioned above.

Figure 3:
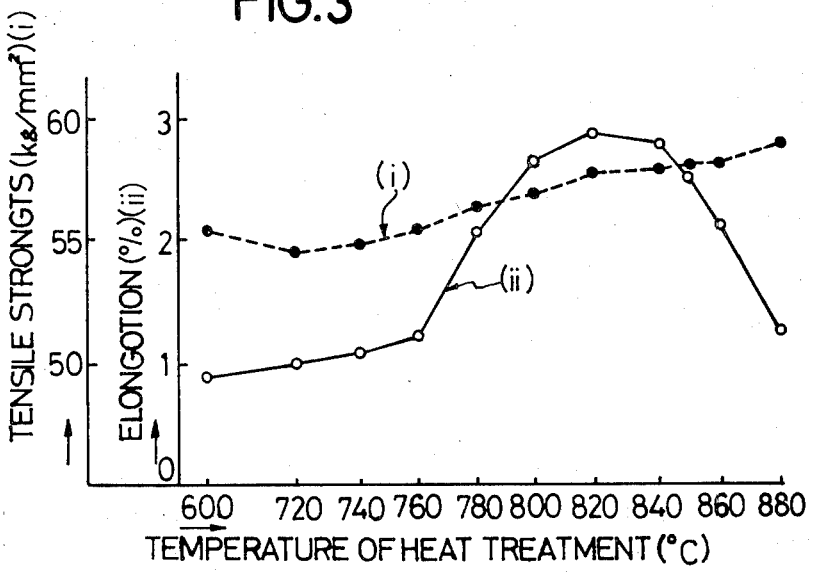
FIG. 3 is a graph showing the relationship between the temperature of the heat treatment and the mechanical property of the roll obtained by the heat treatment.

C portion is the most important process in the heat treatment method of this invention. Namely, after making the structure of the two-phase structure of ferrite and austenite in this portion (C), it is possible to obtain the two-phase structure of ferrite and pearlite, which is the objective of this invention, by transforming austenite into pearlite in the cooling process of the next D portion. The temperature of the heat treatment in this process, has a great effect upon the rolls to be finally obtained. In FIG. 3, the relationship between the temperature of the heat treatment and the mechanical property is shown. The curve (i) is the tensile strength (kg/mm$^2$) and (ii) shows the elongation (%). In this connection the holding time in the heat treatment is two hours in every case. The cooling speed in D process after the heat treatment is 70° C./Hr. The test piece was obtaineded at a position which is 140 mm deep from the surface of the central portion of the roll. The measure and the constituent and composition of the roll to be tested are as follows:

| | |
|---|---|
| Measure of the roll: | 780 mm$^{\phi}$ × 2200 mm$^{l}$ (Barrel portion) |
| Chemical constituent: | C 3.38%, Si 2.03%, Mn 0.49%, P 0.078%, S 0.012%, Ni 1.76%, Cr 0.18%, Mo 0.16%, Mg 0.051%, Barrance iron and unavoidable impurities. |

Figure 8I:
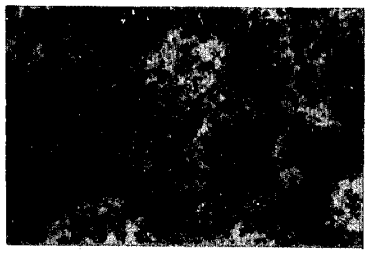
Figure 8:
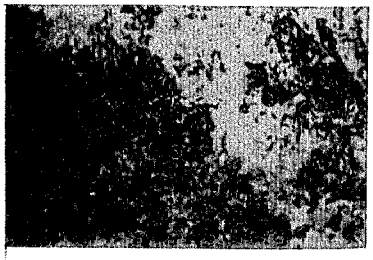
Figure 9I:
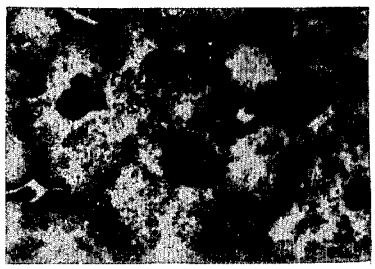
Figure 9:
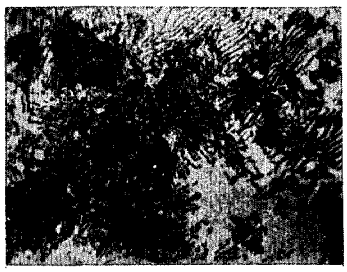

As shown in the figure, the tensile strength will gradually increase in proportion to the rise of the heat treatment temperature while the elongation will abruptly change according to the temperature, the peak being the temperature in the neighborhood of about 820° C. Namely, if the temperature of the heat treatment is less than about 780° C., C in the base will be caught by graphite, thereby the hardness of the base of the roll to be finally obtained will become low and the toughness will also become inadequate due to the ferritized peripheral portion of graphite. On the other hand, if the temperature exceeds about 850° C., the structure will become one-phase of austenite and the objective two-phase base of ferrite and perlite will become unobtainable and the toughness will become remarkably low. Accordingly, the temperature of the heat treatment shall be set at about 780°~850° C. FIGS. 7, 8 and 9 show the microstructures of the rolls which were obtained at the respective temperatures 780° C., 820° C. and 840° C. (In all figures, (I)'s are 100 magnifications and (II)'s are 400 magnifications.) In all cases, the fine two-phase structure of mingled ferrite and pearlite is observed and it is understood that the roll material is structurally excellent in its toughness and abrasion resistivity.

In addition, the formation and the property of the material of the two-phase base structure of the roll in accordance with the present invention depend upon the mutual relationship of 3 factors of the chemical constituent-composition, the heating temperature in step C mentioned above and the holding hours. However, the followings are pointed out as a basic tendency:

In the "low Si %—high Cr" constituent, the toughness is most excellent at the temperature on the low temperature side, while in the "high Si %—low Cr" constituent, the toughness is most excellent at the temperature on the high temperature side. And if the holding time is made longer, the property on the high temperature side will appear. For example, the case where the roll material is held for 10 hours at 800° C. and the case where the roll material is held for less than one hour at 820° C., both will show almost equal hardness and toughness. In the treatment of the constituent-composition according to the present invention, the holding time is not required to exceed about 20 hours. As it is not economical, the holding time may be properly selected within the scope less than 20 hours in accordance with the constituent-composition and the prescribed temperature.

After obtaining the two-phase structure of ferrite and austenite in step C mentioned above, austenite must be transformed into pearlite in the cooling process in the next step D. At this stage, if the cooling speed is less than about 50° C./Hr, pearlite will be granulated in the middle of cooling process which is in the neighborhood of about 720° C., and thereby the hardness will be lowered. With the rise of the cooling speed, pearlite to be created will become close in structure, thus the high hardness and excellent abrasion resistance can be obtained. FIG. 10 is the microstructures of the roll which are obtained in the following way: As the material, the roll which has the same constituent and composition as the roll used in the test shown in FIG. 3 mentioned above is used; the roll is treated by the heat treatment temperature 820° C. and the holding time of two hours; after that the roll is cooled at the cooling speed 300° C./Hr. (In FIG. 10, (I) is 100 magnifications and (II) is 400 magnifications.) When this structure is compared with that of FIG. 8 which is treated under the same heat treatment conditions (however, the cooling speed is 70° C./Hr), it is found that the structure becomes closer. In this connection, the mechanical properties of both materials are compared and the results are summarized as per Table 1.

TABLE 1

| | Step C | Step D | Tensile strength (kg/mm$^2$) | Elongation (%) | Hardness (Hs) |
|---|---|---|---|---|---|
| Roll of FIG. 8 | 820° C. × 2 Hr | 70° C./Hr | 57.9 | 2.90 | 43 |
| Roll of FIG. 10 | 820° C. × 2 Hr | 300° C./Hr | 62.1 | 2.72 | 48 |

As shown in the above table, it is understandable that the strength and hardness (abrasion resistivity) can be improved by the increase of the cooling speed without damaging the toughness. However, the cooling speed exceeding about 300° C./Hr is not only difficult to obtain in the practical operation but also it causes the lowering of the toughness as the base becomes too hard. Accordingly, the cooling speed is made about 50°~300° C./Hr. In addition, the final temperature of step D is set at less than about 600° C. so as to prevent softening of the structure at internal portion of the roll. Step E which follows the cooling process mentioned above is of the stress relief annealing process and the strain and the internal stress of the roll caused by the heat treatment mentioned above are to be removed by holding the roll at the temperature about 450°~650° C. in accordance with the usual method. As to the holding time, it is not necessary to exceed about 20 hours.

Figure 4:
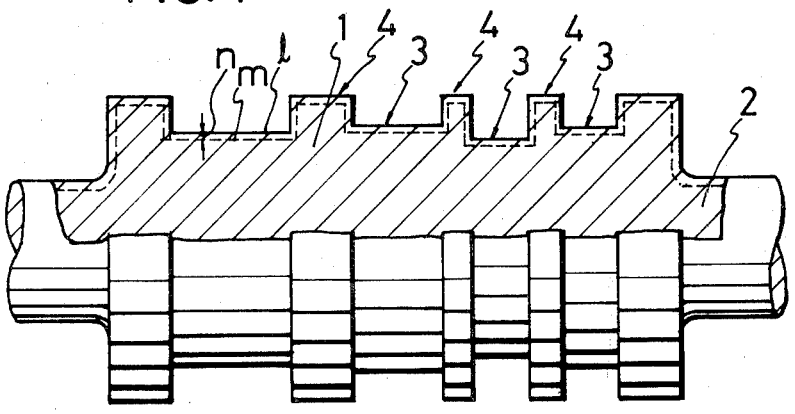
FIG. 4 is a cross sectional view of the principal part showing an example of the roll with calibers.

By the way, when the roll with caliber is the object of the production, the processing of calibers is usually done after the heat treatment. However in such a case, the cooling speed of the roll in the cooling process in step D mentioned above is slower in the inside when compared with that of the surface of the roll and thereby the closeness of pearlite which is created in the inside will become low when compared with that of the surface. Accordingly, the hardness of the inside becomes lower than that of the surface, and as a result, the abrasion resistivity of the bottoms of the calibers which are to be created by the processing will become low. As a countermeasure for this, it is considered to be better to perform the processing of calibers in advance before heat treatment. FIG. 4 is an example of the barrel portion (1) of the roll in which the box-type calibers (3) are formed. The solid line (l) shows the shape of the barrel before performing the heat treatment, in which the calibers are processed leaving the surplus thickness, and the broken line (m) shows the shape of the barrel which is finished by the cutting processing after the heat treatment in accordance with the prescribed measures. The surplus thickness (n) is, in the usual cases, about 1~20 mm which is considered to be enough. In this way, when the above-mentioned heat treatment in accordance with this invention is performed after making the processing of calibers, the cooling speed of the position in the neighborhood of the caliber bottoms will become adequately large, and the closeness of pearlite will be strengthened. As a result, the hardness of the caliber bottoms will become higher by about Hs 1~5 when compared with that of the position on the same radius as aforementioned bottom in the flange portion (4), and thus the abrasion resistivity of the roll will much more be enhanced.

If desired, the roll in accordance with this invention can be a composite construction which consists of sleeve which has the constituent-composition and structure which are prescribed by this invention, and core which is formed by a proper quality of material.

As described above, the ductile cast iron roll in accordance with this invention has a base structure which is consisting of two phases of ferrite which is rich in the toughness mingled with a pearlite which is close and hard in its structure, and therefore, this roll is provided with the excellent abrasion resistance and the superior breaking resistance in addition to the intrinsic toughness of the ductile cast iron roll. Accordingly, if this roll is used as the roll for the rough rolling stand of the hot rolling machine, it will stand well the severe operation conditions and it also will contribute much to the improvement of the efficiency of the rolling works and to the progress of the productivity.

What is claimed is:

1. A ductile cast iron roll having a base structure of a composition comprising 3.0 to 3.8% C, 1.5 to 2.5% Si, 0.2 to 1.0% Mn, 0.01 to 0.2% P, less than 0.06% S, 0.7 to 3.0% Ni, 0.1 to 0.6% Cr, 0.1 to 0.8% Mo, 0.02 to 0.1% Mg, all percents being weight %, the balance iron and unavoidable impurities, said base structure characterized by being substantially a two-phase structure of ferrite and pearlite.

2. A ductile cast iron roll as described in claim 1 wherein a Al less than 0.3% is contained in the said cast iron.

3. A ductile cast iron roll as described in claim 1 or 2 wherein a total of 0.05% of rare earth elements are added to the said cast iron.

4. A ductile cast iron roll as described in claim 1, further containing calibers, wherein the hardness of the bottom surface of said calibers is higher by Hs 1–5 than that of the flange portion which is on the same radius as the said bottom surface.

5. A method of manufacturing a ductile cast iron roll, said roll produced from a cast iron having a composition comprising 3.0 to 3.8% C, 1.5 to 2.5% Si, 0.2 to 1.0% Mn, 0.01 to 0.2% P, less than 0.06% S, 0.7 to 3.0% Ni, 0.1 to 0.6% Cr, 0.1 to 0.8% Mo, 0.02 to 0.1% Mg, all percents being weight %, balance iron and unavoidable impurities, said method comprising holding the cast iron at a temperature of 780° to 850° C. for less than 20 hours, cooling to 600° C. at a cooling speed of 50° to 300° C./Hr, and then maintaining at 450° to 650° C. for less than 20 hours.

6. The method of claim 5 wherein said cast iron contains, in addition, a positive amount of aluminum of less than 0.3% by weight.

7. The method of claim 5 wherein said cast iron contains, in addition, a positive amount of rare earth elements in an amount of less than 0.5% by weight.

8. The method of claim 5 further including calibers, said calibers formed prior to said heat treatment.

9. A ductile cast iron roll having a base structure of a composition comprising 3.0 to 3.8% C, 1.5 to 2.5% Si, 0.2 to 1.0% Mn, 0.01 to 0.2% P, less than 0.06% S, 0.7 to 3.0% Ni, 0.1 to 0.6% Cr, 0.1 to 0.8% Mo, 0.02 to 0.1% Mg, all percents being weight %, the balance iron and unavoidable impurities, said base structure characterized by being substantially a two-phase structure of ferrite and pearlite and having a tensile strength in the range of 54 to 62.1 kg/mm$^2$ and an elongation percent of 1.9 to 2.9.

* * * * *